United States Patent [19]

Spradling

[11] 4,265,414

[45] May 5, 1981

[54] APPARATUS FOR WINDING FIRE HOSE

[76] Inventor: Michael D. Spradling, 860 Montana, Marysville, Mich. 48040

[21] Appl. No.: 161,212

[22] Filed: Jun. 19, 1980

[51] Int. Cl.[3] ..... B65H 75/40

[52] U.S. Cl. ..... 242/86.2

[58] Field of Search ..... 242/96, 86, 86.1, 86.2, 242/86.5 R, 86.52; 137/355.12, 355.16, 355.2

[56] References Cited

U.S. PATENT DOCUMENTS

| | | | |
|---|---|---|---|
| 372,473 | 11/1887 | Kimball | 242/86.2 |
| 3,124,321 | 3/1964 | Ryloft | 242/86.2 |
| 3,319,905 | 5/1967 | Kissilov | 242/86.2 |
| 3,946,964 | 3/1976 | Zinser | 242/86.5 R |
| 4,057,198 | 11/1977 | Whitfield | 242/86.2 |
| 4,198,010 | 4/1980 | Knapp | 242/86.2 |

*Primary Examiner*—Edward J. McCarthy

*Attorney, Agent, or Firm*—Basile, Weintraub & Hanlon

[57] ABSTRACT

A collapsible, hand-operated apparatus for winding a length of fire hose of the type having male and female interlocking members on opposite ends is disclosed. The apparatus includes a support member on which is mounted a horizontally disposed shaft having one end operatively connected to a hand crank which, when operated, rotatably drives a disc member carried at the opposite end of the shaft. The disc member has a pair of outwardly extending, elongated tines for engaging the male coupling member of the hose. The hose is directed to reel past an idler spool adapted to rotate about a horizontal axis which is radially and vertically displaced from the axis of rotation of the disc member. This arrangement serves to compress the hose and drain any water that may be present therein as well as serving to align the hose with the tines as the hose is spirally wound about the disc member. The apparatus is provided with a simple mechanism for collapsing the apparatus for easy storage when not in use.

5 Claims, 6 Drawing Figures

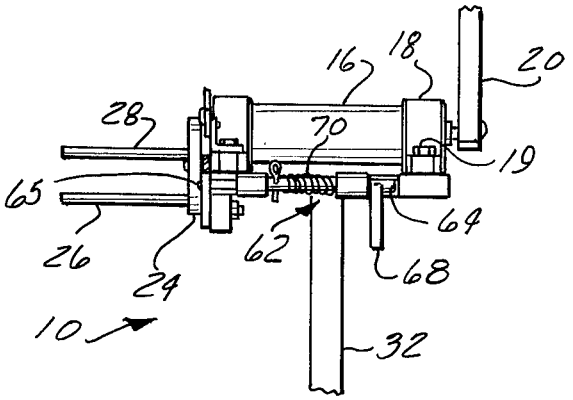
Fig-3
Fig-4
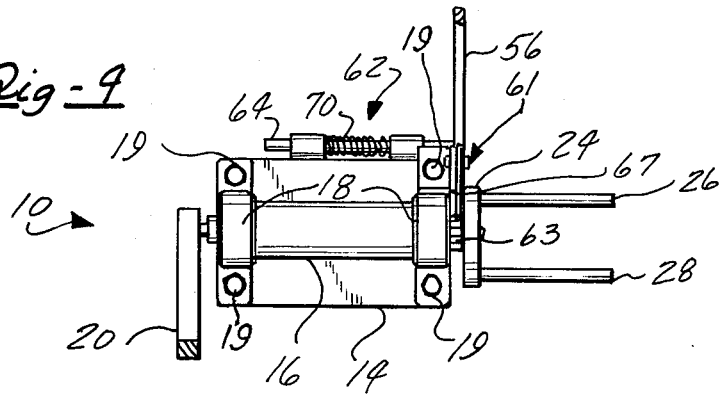
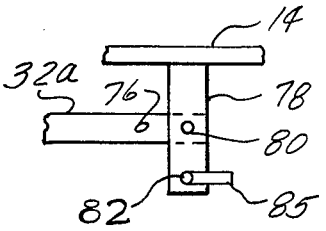
Fig-5
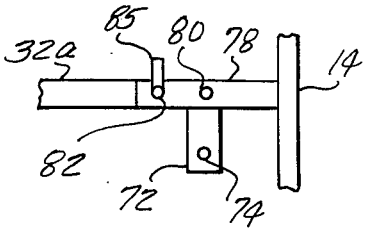
Fig-6

APPARATUS FOR WINDING FIRE HOSE

BACKGROUND OF THE INVENTION

I. Field of the Invention

The present invention relates to apparatuses for winding fire hoses and, in particular, to an apparatus which is of a collapsible construction.

II. Description of the Prior Art

After a fire-fighting operation, each length of fire hose must be wound up at the scene of the fire for the return trip to the fire station. At the station the hose must be unrolled and placed on drying racks and then wound up again for storage. Furthermore, safety regulations require that all fire hose be unwound and inspected at regular intervals and, of course, the hose must be rewound for storage. Virtually all of these winding operations are presently performed by the firemen manually winding the hose into a spiral roll. Before the manual winding operation is begun, the firemen must drain the water from the hose and arrange the hose into a straight line.

Apparatuses for winding hose have been proposed, and examples of such prior art are disclosed in U.S. Pat. Nos. 3,124,321 and 4,057,198. U.S. Pat. No. 3,124,321 describes a device having a gasoline engine which drives a reel about a horizontal axis through a series of sprocket chains and gear reducers. The reel includes a large disc member from which extends a pair of tines for engaging the coupling member at one end of the hose. A hose guide adapts the device to different widths of hose. One disadvantage of this device is that the hose is not sufficiently compressed or otherwise acted upon by the apparatus to automatically drain the water from the hose, and therefore the hose must be drained as a step preparatory to winding. Another disadvantage to this product is that it is complicated in design requiring a variety of elements to achieve the desired goal of winding the hose.

The apparatus disclosed in U.S. Pat. No. 4,057,198 has a horizontal base mounted on four wheels and an upright support structure which mounts a reel assembly. The reel assembly includes a circular disc mounted on a drive shaft which is driven by a hand crank. The disc has a pair of outwardly extending, elongated tines for engaging the male coupling member of a hose, with the hose being directed to the reel past an idler roller and an adjustable hose guide assembly which serves to compress the hose and drain any water which may be present. The adjustable guide also serves to align the hose with the tines so that it does not have to be straightened before the winding operation. This device has disadvantages in that it requires considerable structure and components in order to achieve the desired goal of spirally winding the hose. Both structures disclosed in the aforementioned patents are large, cumbersome and are not collapsible for easy storage.

PRIOR ART STATEMENT

In the opinion of the applicant and applicant's attorney, the aforementioned prior art is the most relevant art of which they are aware.

SUMMARY OF THE INVENTION

The present invention, which will be described subsequently in greater detail, comprises a fire hose winding apparatus that has a horizontally disposed base which supports a shaft adapted for rotation about a horizontal axis. The shaft is rotated by a hand crank connected to one end thereof, while the other end of the shaft mounts a disk member which, in turn, supports a pair of laterally spaced tines extending laterally therefrom. The tines are eccentrically spaced from the horizontal axis of the shaft and are adapted to receive thereinbetween a portion of the fire hose so as to align an end coupling member of the hose about the horizontal axis of the shaft. A spool guide, which is also supported for rotation about a horizontal axis, is mounted at a position which is both radially and vertically spaced from the first horizontal axis and cooperates with the tines to guide the hose as the same is spirally wound about the first horizontal axis.

It is therefore an object of the present invention to provide a new and improved apparatus for winding a fire hose.

It is a further object of the present invention to provide an apparatus for winding fire hose, which apparatus is a simple, hand-operated device adapted to automatically drain water from the hose, which may be collapsed and stored when not in use and which is of a light-weight and simple construction permitting its simple movement.

Other objects, advantages and applications of the present invention will become apparent to those skilled in the art of fire hose winding apparatuses when one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 3 is a fragmentary view of the apparatus as seen from LINE 3—3 of FIG. 1;

FIG. 4 is a fragmentary top plan view of the apparatus as seen from Line 4—4 of FIG. 1;

FIG. 5 is a fragmentary view of the apparatus showing a modification thereof; and FIG. 6 is a fragmentary view of the modification illustrated in FIG. 5, the same being illustrated in a stored position.

DESCRIPTION OF THE PREFERRED EMBODIMENTS

Figure 1:
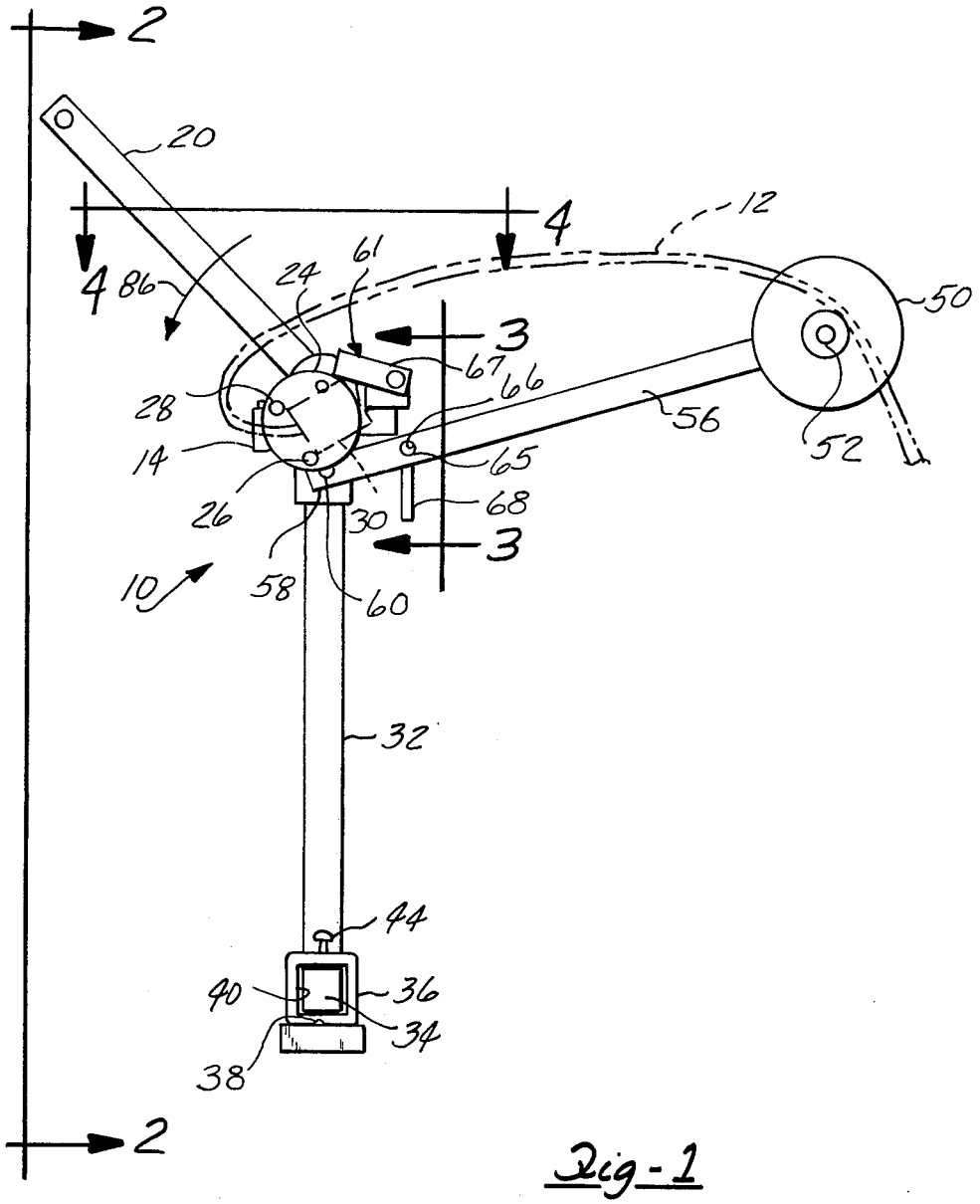
FIG. 1 is a front elevational view of a fire hose winding apparatus incorporating the principles of the present invention.
Figure 2:
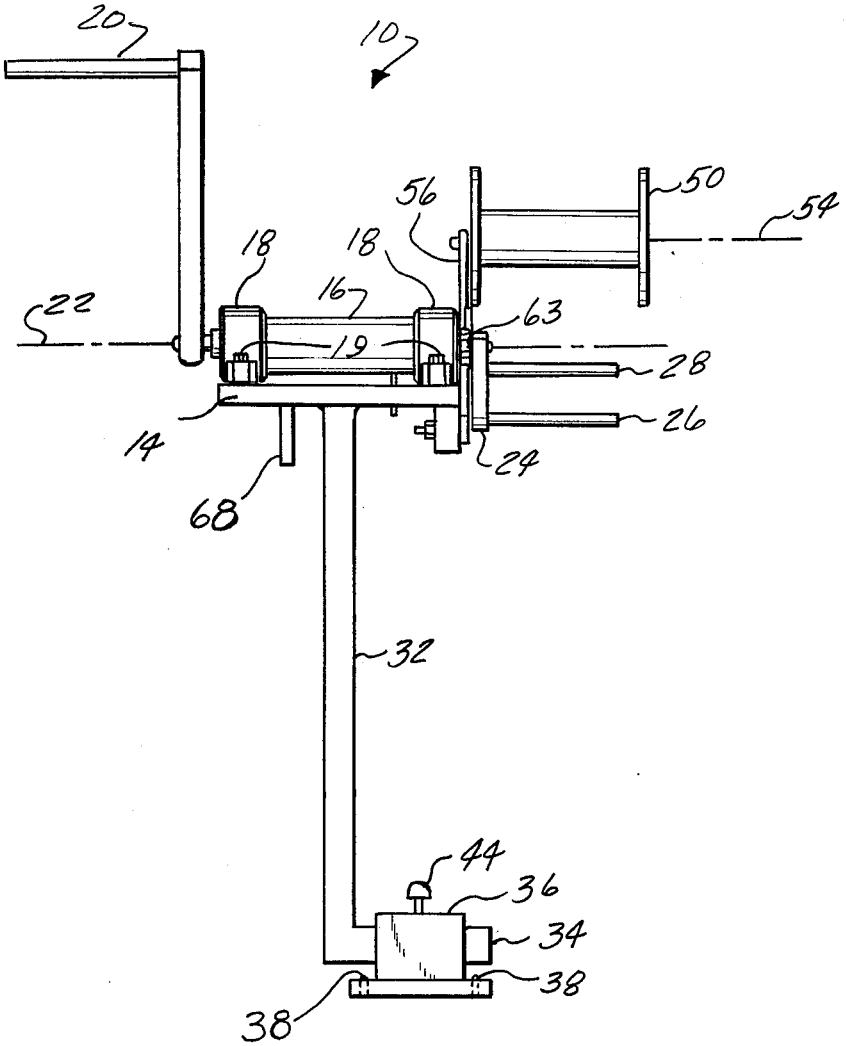
FIG. 2 is a side elevational view of the apparatus as seen from Line 2—2 of FIG. 1.

Referring now to the drawings and, in particular, to FIGS. 1 through 4 wherein there is illustrated one example of the present invention in the form of an apparatus 10 for winding a fire hose 12. The apparatus 10 comprises a base 14 on which is rotatably carried a shaft 16. The shaft 16 is mounted to the base 14 by any suitable means, such as bearing mounts 18 attached to the base 14 by screws 19. The shaft 16 has a manually operated crank 20 connected to one end thereof such that rotation of the crank 20 in a conventional manner will cause the shaft 16 to rotate about a horizontal axis 22 (FIG. 2). The forward end of the shaft 16 mounts a disc member 24 which is also adapted to rotate about the horizontal axis 22 when the hand crank 20 is turned.

A pair of vertically spaced tines 26 and 28 project substantially laterally of the disc member 24 and are radially displaced from the horizontal rotational axis 22. Tines 26 and 28 are rigidly carried on the disc 24 as, for example, by welding the inner ends of the tines 26 and 28 to the disc member 24. The tines 26 and 28 are adapted to receive the fire hose 12 thereinbetween and to align one of the interlocking coupling members 30 such that the center of gravity of the coupling member 30 generally intersects the horizontal rotational axis 22 of the shaft 16.

The base 14 is supported in a horizontal position by means of a vertical support arm 32 which has a lower bent end 34 that is received by coupling member 36. Coupling member 36 may in turn be fastened to a fire engine by any suitable fastening devices, such as bolts 38, that extend through suitable apertures in the coupling member 36 into threaded holes in the engine. The coupling member 36 has a complementarily shaped aperture 40 (FIG. 1) adapted to receive the bent end 34 of the support member 32. Alignment of apertures in the bent end 34 and the coupling member 36 permits the passage of a locking pin 44 to securely fasten the apparatus 10 to the fire engine.

As can best be seen in FIGS. 1 and 2, the apparatus 10 includes a hose guide in the form of an idler spool 50. Spool 50 is rotatably carried on a shaft 52 such that the spool 50 will rotate about a second horizontal axis 54 (FIG. 2) that is both laterally and vertically spaced from the horizontal axis 22. As can best be seen in FIG. 1, the shaft 52 is carried by a support arm 56.

The inner end 58 of the arm member 56 is pivotally mounted to the base 14 by means of a pin 60 that extends into a suitable aperture (not shown) in the base 14 such that the arm 56 may be rotated from the position shown to one where it is collapsed and disposed in a vertical position, and the arm member 56 is close to and parallel to the support leg 32.

As can best be seen in FIGS. 3 and 4, a detent assembly 62 includes a horizontally movable pin 64 having an end 65 that is adapted to be received in a locking aperture 66 (FIG. 1) formed in the arm member 56. It can thus be seen that when the pin 64 is moved to a position wherein the locking pin 64 engages the aperture 66, the arm 56 is locked in the position shown in FIG. 1; that is, the horizontal axis 54 is both vertically and horizontally displaced from the axis 22. Locking pin 64 has a handle 68 which permits the user to move the same to and from engagement with the aperture 66 against the bias of the spring 70, which normally urges the pin 64 toward locking engagement with the locking aperture 66 carried by the arm member 56.

The apparatus 10 includes a ratchet assembly 61 in the form of a ratchet gear 63 formed on shaft 16 which engages a ratchet pin 67 on the conventional manner to prevent unwinding of the hose 12.

FIGS. 5 and 6 illustrate a modification of the present invention wherein the leg 32 is adapted to be normally disposed in a horizontal position and attached to a suitable vehicle, such as a fire truck. In the example illustrated a support leg 32A has an L-shaped end 72 which includes a locking aperture 74. Leg 32A also includes a second locking aperture 76. The base 14 has a lower support element 78 which is pivotally connected through a suitable hinge arrangement 80 to the end of the leg 32A. The lower end of the support element 78 includes a second aperture 82 which, in the position illustrated in FIG. 5, is aligned with the aperture 74 so as to receive a suitable locking pin 85 therethrough and lock the base 14 in the position illustrated and permit the apparatus 10 to be utilized. When it is desired not to use the apparatus 10 and storage of the same is required, the base 14 may be rotated to the position illustrated in FIG. 6 and the locking pin 85 extended through the aperture 82 into the axially aligned aperture 76 so as to secure the support member 14 in the position illustrated.

It should be noted that the idler spool 50 functions to provide a simple means for guiding the hose 12 to the tines 26 and 28, while at the same time the water in the hose is automatically drained during the winding operation, as very little water will pass over the spool 50 since the spool 50 is both vertically and horizontally displaced from the axis 22.

In operation the end of the hose containing one of the coupling members 30 is placed between the tines 26 and 28, and the operator turns the hand crank 20 so as to rotate the shaft 16 in the direction indicated by the arrow 86 in FIG. 1 until the entire hose length is formed into a spiral roll. Thereafter the roll may be manually removed from the tines 26 and 28 to provide a simply and conveniently rolled spiral of fire hose.

It should be appreciated that the hose 12 can be folded in half with the two coupling members 30 being adjacent to each other. The folded end of the hose 12 is then inserted between the tines 26 and 28 and the folded hose 12 is formed into a spiral roll in the manner hereinbefore described.

It should be understood by those skilled in the art of apparatuses for rolling fire hoses that other forms of the present invention may be had, all coming within the spirit of the invention and scope of the appended claims.

What is claimed is as follows:

1. A collapsible apparatus for winding a hose, said apparatus comprising:

a vertically disposed disc member supported for rotation about a horizontal axis;

means for rotating said disc member about said horizontal axis;

a pair of spaced tines extending laterally from said disc member and being eccentrically spaced from said horizontal axis, said tines being spaced to receive said hose thereinbetween and align a portion of said hose with said horizontal axis; and a spool guide supported for rotation about a second horizontal axis radially spaced from said horizontal axis and cooperating with said tines to guide said hose as said hose is spirally wound about said tines as said disc member is rotated, said spool guide being vertically displaced above said first horizontal axis.

2. The collapsible apparatus defined in claim 1 wherein said means for rotating said disc member is a hand crank.

3. The collapsible apparatus defined in claim 1 wherein said hose is of the type having interlocking coupling members at opposite ends, said tines receiving said hose thereinbetween to align one of said coupling members with said horizontal axis.

4. The collapsible apparatus defined in claim 3 wherein said apparatus is adapted for mounting on a vehicle and further comprising means for supporting said apparatus on said vehicle, said supporting means being releaseably attachable to said vehicle.

5. The apparatus defined in claim 1 further comprising a means for supporting said disc member; and a support arm having one end pivotally mounted to said support member such that said arm may be moved to a position wherein it is inclined upwardly from said support member to a second position wherein it is lowered to a collapsed position, said spool guide being carried at the other end of said support arm so that it may be disposed in a position which is both radially spaced and vertically displaced above said first horizontal axis.

* * * * *